US005688327A

United States Patent [19]

Swain et al.

[11] Patent Number: 5,688,327

[45] Date of Patent: Nov. 18, 1997

[54] CHUCK ASSEMBLY HAVING A CONTROLLED VENT

[75] Inventors: Eugene A. Swain, Webster; Peter J. Schmitt, Ontario, both of N.Y.

[73] Assignee: Xerox Corporation, Stamford, Conn.

[21] Appl. No.: 607,064

[22] Filed: Feb. 26, 1996

[51] Int. Cl.[6] ..... B05C 13/00

[52] U.S. Cl. ..... 118/500; 279/126; 279/2.06; 279/2.09

[58] Field of Search ..... 279/126, 2.06, 279/2.09; 454/238; 96/193; 118/500, 668, 698, 707, 712; 137/587

[56] References Cited

U.S. PATENT DOCUMENTS 3,777,875 12/1973 Sobran ..... 198/131

3,909,021 9/1975 Morawski et al. ..... 279/2 R 3,945,486 3/1976 Cooper ..... 198/179

4,680,246 7/1987 Aoki et al. ..... 430/133

4,783,108 11/1988 Fukuyama et al. ..... 294/98.1

*Primary Examiner*—Donald E. Czaja

*Assistant Examiner*—Michael P. Colaianni

[57] ABSTRACT

A chuck assembly for engaging the inner surface of a hollow substrate including: (a) a body defining a hole, wherein the hole is positioned to be in communication with the air inside the substrate; and (b) a gas pressure regulating apparatus coupled to the hole for regulating the gas pressure inside the substrate.

11 Claims, 5 Drawing Sheets

CHUCK ASSEMBLY HAVING A CONTROLLED VENT

CROSS REFERENCE TO RELATED APPLICATIONS

Attention is hereby directed to concurrently filed application Ser. No. 08/607,065 (D/95348) titled "Method For Controlling a Substrate Interior Pressure" having the inventors, Ronald E. Godlove, Huoy-Jen Yuh, and John S. Chambers, the disclosure of which is hereby totally incorporated by reference.

BACKGROUND OF THE INVENTION

This invention relates generally to an apparatus for internally holding a substrate such as a drum or a belt for processing. More specifically, the invention relates to a chuck assembly having apparatus for controlling the gas pressure in the substrate during immersion in a solution.

During dip coating of a substrate in for example a photosensitive coating solution, the burping phenomenon may occur, especially when dipping drums or belts having large diameters. This is because a large surface area of the coating solution containing a volatile solvent is exposed to evaporation inside the substrate, thereby resulting in a pressure buildup. The resulting increase in pressure causes a volume increase and the gas (typically air) escapes from inside the substrate shortly before it emerges from the coating solution. This escape usually causes a solution surface disturbance and results in a nonuniform coating thickness on the substrate. There is thus a need, which the present invention addresses, for a chuck assembly to alleviate the burping problem.

Conventional substrate holding devices grip the insides of a hollow substrate by using for example an inflatable member. Known gripping devices are illustrated by the following documents, several of which disclose an inflatable member: Fukuyama et al., U.S. Pat. No. 4,783,108; Aoki et al., U.S. Pat. No. 4,680,246; Cooper, U.S. Pat. No. 3,945,486; and Sobran, U.S. Pat. No. 3,777,875.

Morawski et al., U.S. Pat. No. 3,909,021, discloses a collet chuck for gripping the bore of a workpiece. The chuck has an axially slotted outer expandable work-gripping sleeve and an inner collet expander. The sleeve and expander are relatively axially shiftable to expand and contract the sleeve. The slots are filled with an elastomer and the open end of the sleeve has a rubber cap thereon, the elastomer filled slots and the rubber cap preventing the ingress of dirt, chips, and the like into the work-gripping sleeve.

Eugene A. Swain et al., U.S. application Ser. No. 08/338,062 (D/94573) now U.S. Pat. No. 5,520,399, the disclosure of which is totally incorporated by reference, discloses a chuck assembly for engaging the inner surface of a hollow substrate comprising: (a) a fluid impermeable elastic membrane including a substrate engaging portion, wherein the inner surface of the membrane defines an interior space; and (b) a plurality of radially movable members at least partially disposed in the interior space, wherein the membrane is dimensioned to provide a radially inward force on the members, wherein the members in a radially expanded position push the substrate engaging portion of the membrane against the substrate inner surface, and wherein the peripheral dimension of the elastic membrane decreases when the members are in a radially contracted position.

SUMMARY OF THE INVENTION

The present invention is accomplished in embodiments by providing a chuck assembly for engaging the inner surface of a hollow substrate comprising:

(a) a body defining a hole, wherein the hole is positioned to be in communication with the air inside the substrate; and (b) a gas pressure regulating apparatus coupled to the hole for regulating the gas pressure inside the substrate.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in the Figures refers to the same or similar feature.

DETAILED DESCRIPTION

Figure 1:
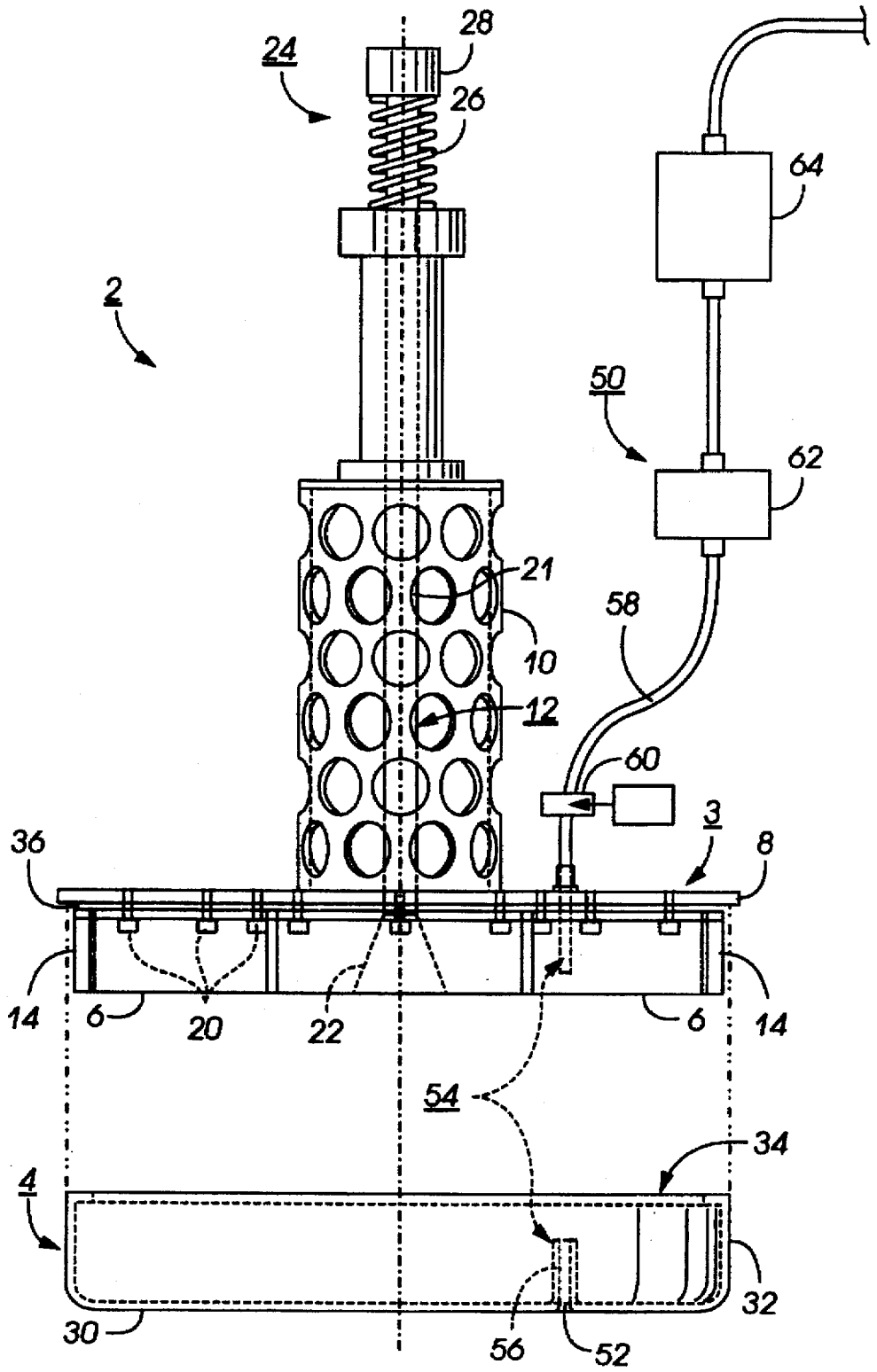
FIG. 1 represents a schematic, side view of the inventive chuck assembly.
Figure 2:
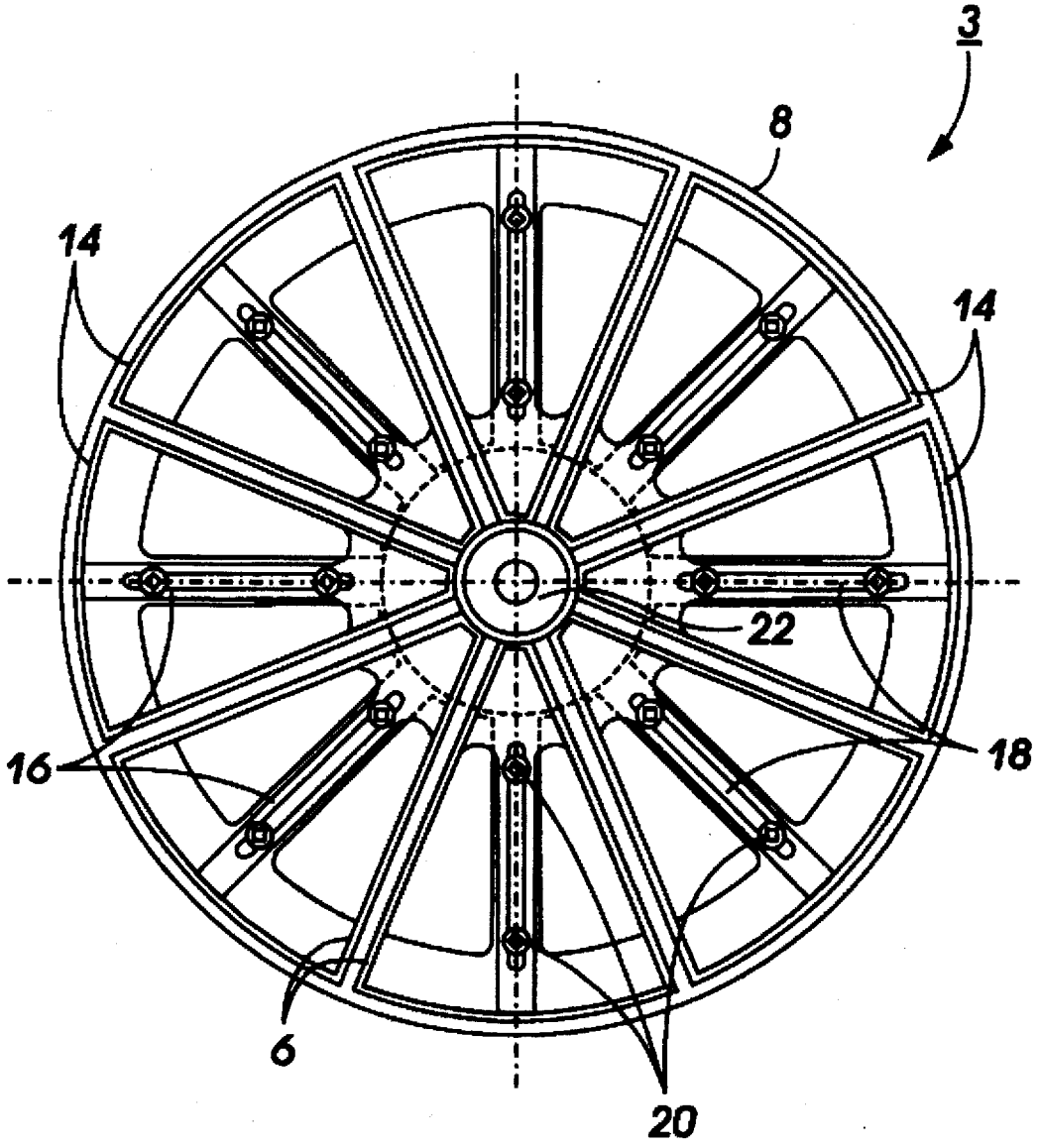
FIG. 2 represents a bottom view of the chuck depicted in FIG. 1.

FIGS. 1 and 2 illustrate one embodiment of the instant invention where chuck assembly 2 is comprised of chuck 3, a fluid impermeable elastic membrane 4 defining a hole 52, and a gas pressure regulating apparatus 50, whereby chuck 3 and membrane 4 are collectively referred to herein as the body. The chuck 3 is comprised of a plurality of radially movable members 6, plate 8, housing 10, and means 12, operatively associated with the members 6, for moving substantially simultaneously the members into a radially expanded position.

The members 6 are preferably triangularly-shaped and may be circumferentially arranged. The side 14 (herein referred to as the "peripheral side" of the member) of each member 6 disposed at the periphery of plate 8 may be curved so that the plurality of members together presents a generally circular peripheral surface. The members are operatively associated with the plate by any suitable configuration which permits movement, preferably radial movement, of the members. Each member 6 may be a solid piece, but preferably is hollow with an open bottom side and a top side which includes openings which define a segment 16. The segment 16 defines a slot 18. Screws 20 disposed in slot 18 couple each member to plate whereby the members are free to move radially along the track defined by the slot. The members may move independently of one another. The number of members ranges for example from 4 to 14, and preferably from 6 to 10. The members may be molded segments and are fabricated from any suitable material such as a metal or plastic. A preferred class of materials are high temperature and low mass polymeric materials such as TEFLON™ (i.e., tetrafluoroethylene), ULTEM 1000™ (polyetherimide) available from General Electric Company, TORLON™ (polyamideimide) available from Amoco Chemicals, and VALOX FV-608™ (polyester) available from General Electric Company. In embodiments, the members may be made from metallic or polymeric composite honey comb.

The plate 8 may be circular and may define a plurality of openings. The plate may be fabricated from any suitable material including a metal like steel or aluminum.

The housing 10, which encloses a substantial part of means 12, may define a plurality of openings and may be coupled to the plate 8. The housing may be fabricated from any suitable material including a metal like steel or aluminum.

Means 12 may comprise for example a vertically movable rod 21 including a conically-shaped end portion 22, wherein the conically-shaped end portion may be operatively associated with the plurality of the members 6. The end of the rod 21 may be coupled to a spring assembly 24 comprised of spring 26 and activator member 28. The spring 26 contacts the housing 10. The members 6 may be circumferentially arranged around the conically-shaped end portion 22, whereby the radially inward force exerted by the membrane 4 urges the members against the conically-shaped end portion. The members may have a blunt, curved tip to facilitate contact with the conically-shaped end portion. The means 12 may be fabricated of any suitable material including metal or plastic.

The elastic membrane 4 may comprise for example a disk portion 30 and an integral side portion 32 formed around the periphery of the disk portion. The end of the side portion may include a flange (not shown). The side portion constitutes in embodiments the substrate engaging portion of the membrane. The inner surface of the membrane defines an interior space 34. The membrane is slipped over the members so that the optional flange may engage an optional circumferential gap 36 between the plate 8 and the members 6. The membrane is dimensioned to provide a radially inward force on the members. The members are partially or entirely disposed in the interior space 34 of the membrane. The side portion 32 of the membrane covers at least a part of the peripheral side 14 of the members ranging for example about 50% to 100% of the height of the peripheral side. The membrane has the following characteristics: fluid impermeability; a thickness ranging for example from about 0.4 mm to about 15 mm, and preferably from about 0.7 mm to about 3 mm; and a durometer value ranging for example from about 20 to about 90, and preferably from about 30 to about 60. The membrane may be fabricated from any suitable material including for instance silicone, such as silicone rubber compound no. 88201 available from Garlock Corporation, and flexible/elastic high temperature elastomers such as VITON™ and ZETPOL 2000™ (hydrogenated nitrile elastomer—HNBr). The hole in the elastic membrane may be of any suitable diameter such as from about 5 to about 15 mm and is preferably positioned at the disk portion 30.

The elastic membrane may serve several functions. First, the membrane may provide a radially inward force on the members. Second, the membrane may provide in embodiments a hermetic seal when the chuck assembly is engaged with the substrate. Third, the membrane provides a "thermal break," i.e., function as a heat insulator, during heating of the substrate in a processing step.

As seen in FIG. 1, the gas pressure regulating apparatus 50 preferably comprises a conduit 54, a needle valve 60 for controlling the mount of fluid flow in the conduit, a solenoid valve 62 for turning on and off the fluid flow in the conduit, and an optional gas injection apparatus 64 for introducing additional gas into the substrate interior. The conduit 54 comprises tubing either a single tube, or a series of 2, 3 or more connected tubes. As seen in FIG. 1, conduit 54 comprises a shorter vent tube 56, which can be molded to the hole 52 as a pan of the membrane 4, and a longer tube 58 to be connected to the vent tube 56. The vent tube 56 can also be a separate piece which is joined to the hole 52 by for instance an adhesive such as Loctite Superflex Silicone RTV Adhesive Sealant or one similar thereto. The conduit can be fabricated from a metal such as stainless steel or aluminum or a polymeric material such as plastic and can have any suitable inner diameter such as from about 5 to about 15 mm. The conduit may extend through the chuck interior and is coupled to other components of the gas pressure regulating apparatus 50.

Operation of the embodiment depicted in FIGS. 1–2 proceeds as follows. The embodiment shown in FIG. 1 illustrates the radially expanded position of the members, whereby the chuck assembly 2 has the maximum width. Prior to engagement of the chuck assembly with a substrate, the activator member 28 is depressed which pushes the coupled rod 21 and the conically-shaped end portion 22 downwards and compresses the spring 26. As the conically-shaped end portion moves downward, the members 6, urged on by the radially inward force exerted by the elastic membrane 4, are able to move inward since the taper of the conically-shaped end portion presents a decreased cross-sectional dimension. Radially inward movement of the members results in a decrease in the peripheral dimension of the assembly of the members and of the elastic membrane such that the width of the chuck assembly is less than that of the inner dimension of the substrate. The portion of the chuck assembly including the members and the membrane is inserted into the hollow substrate. Preferably, the substrate is positioned on its end and the chuck assembly moves vertically downward into the substrate. For the chuck assembly to engage the substrate, pressure on the activator member 28 is decreased whereby the compressed spring 26 expands, thereby pushing up the activator member, the rod 21, and the conically-shaped end portion 22. Movement upwards of the conically-shaped end portion pushes radially outward the members since the taper of the conically-shaped end portion presents an increased cross-sectional dimension. It is preferred that radial movement of the members, whether inwardly or outwardly, occur generally simultaneously and substantially uniformly. Movement of the members radially outwards increases the peripheral dimension of the assembly of the members and of the membrane, whereby the peripheral side of the members push the membrane against the inner surface of the substrate. Typically only the membrane, especially the side portion 32, may contact the substrate inner surface. However, in embodiments of the instant invention, an uncovered portion of the peripheral side of the members may also contact the substrate inner surface. After processing of the substrate, the activator member is depressed to shrink the width of the chuck assembly, thereby allowing withdrawal of the chuck assembly from the substrate.

During engagement of the chuck assembly with the substrate, it is generally preferred that a hermetic seal is created by contact of the membrane against the substrate inner surface to minimize or prevent fluid migration, especially liquid, into the interior of the substrate during for example dip coating. However, the gas pressure regulating apparatus 50 permits controlled gas venting which may be useful in several situations. For example, one may wish to allow cleaning fluid inside the substrate in a dip cleaning process: when the dip cleaning step takes place, the solenoid valve 62 is opened which allows the cleaning fluid to migrate up inside the substrate and remove contamination; and during the following dip coating steps, the solenoid valve is closed which prevents fluid migration into the substrate interior. In addition, controlled gas venting may eliminate the burping problem and the need for float devices in certain coating solutions. Float devices reduce the surface area of exposed evaporating coating solutions which in turn prevents burping, a condition in which pressure from solvent evaporation builds up inside the substrate during dipping and escapes as a burp or gas bubble as the lower edge of the substrate nears being withdrawn from the solution. The burp disturbs the coating uniformity of the dip coated layer on the substrate. At this point of withdrawal of the substrate end from the solution, a controlled venting of a portion of the gas in the substrate interior could occur thereby eliminating the gas pressure build up inside the substrate. Elimination of float devices is a significant cost savings. The gas injection apparatus 64 could be used in certain embodiments to force gas such as air into the substrate interior to displace solvent laden air which retards drying of the lower edge coating bead on the substrate. In addition, during certain parts of the coating process, heated air could be injected into the interior of the substrate thereby heating the substrate and facilitating flashoff or drying of the coated layer on the substrate.

Any suitable rigid or flexible substrate may be held by the substrate holding apparatus of the present invention. The substrate may have a cylindrical cross-sectional shape or a noncylindrical cross-sectional shape such as an oval shape. The substrate may be at least partially hollow, and preferably entirely hollow, with one or both ends being open. In preferred embodiments, the substrate is involved in the fabrication of photoreceptors and may be bare or coated with layers such as photosensitive layers typically found in photoreceptors. The substrate may have any suitable dimensions. An advantage of the chuck assembly in embodiments is that it embodies low mass and therefore may not cause excessive heat flow from a thin substrate to the chuck assembly when placed in an oven.

Figure 3:
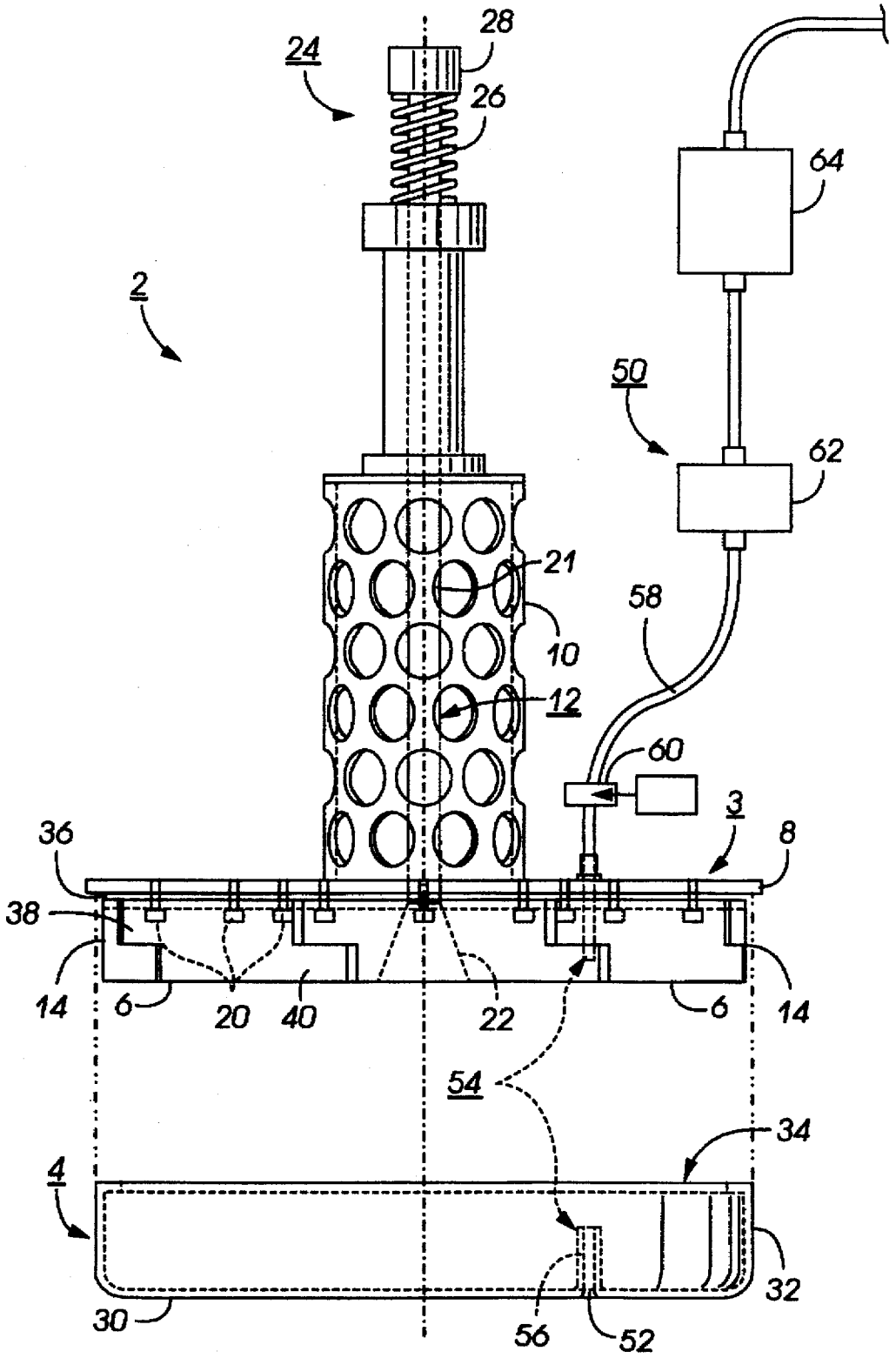
FIG. 3 represents a schematic, side view of another embodiment of the chuck assembly.
Figure 4:
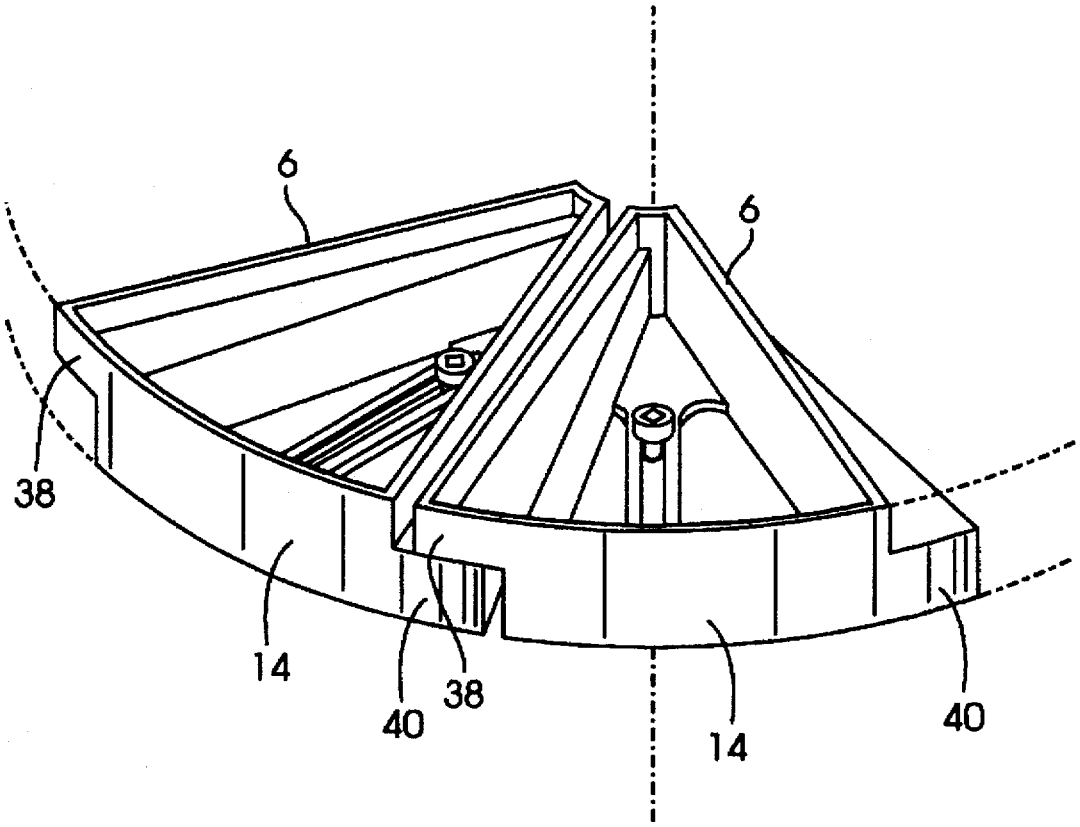
FIG. 4 represents a partial, perspective view of adjoining members of the chuck depicted in FIG. 3.

FIGS. 3 and 4 illustrate another embodiment of the instant invention where adjoining members 6 overlap and contact one another in the overlapping area. Each member 6 may include both an integral overlying portion 38 and an integral underlying portion 40 whereby the overlying portion 38 of each member overlaps and contacts the underlying portion 40 of the adjoining member. The overlaying portion and the underlying portion of each member preferably extend along the entire length of the member. In this embodiment, the contact surfaces of the members may be optionally coated with a layer of a low friction material such as TEFLON™ to minimize any friction which may inhibit the radial movement of the members. This configuration of FIGS. 3–4 is advantageous when the diameter of the substrate is large which may necessitate larger gaps between members 6 or when a low durometer membrane is utilized. Large gaps between members and/or a low durometer membrane may in some instances result in loss of the hermetic seal in the embodiment of FIGS. 1–2 due to the loss in compression of the membrane across the gap (i.e., if the membrane recedes into the gap between adjacent members). The embodiment illustrated in FIGS. 3–4 and similar embodiments minimize or eliminate the possibility of a loss of the hermetic seal by having adjacent members overlap and contact one another in the overlapping area, thereby bridging or closing the gap. The same gas pressure regulating apparatus 50 shown in FIG. 1 is depicted in FIG. 3. Operation of the chuck assembly depicted in FIGS. 3–4 proceeds in the same manner as for the embodiment illustrated in FIGS. 1–2 discussed above.

In additional embodiments of the invention, the circumferential surface of the chuck defined by the peripheral sides 14 of the members has a groove (not shown). A coil spring (not shown) is present in the groove so that the coil encircles the circumferential surface of the chuck. The coil may exert an inwardly radially force.

In other embodiments, each member is coupled to the same or different internally disposed spring (not shown) to exert an inwardly radially force on the members.

Figure 5:
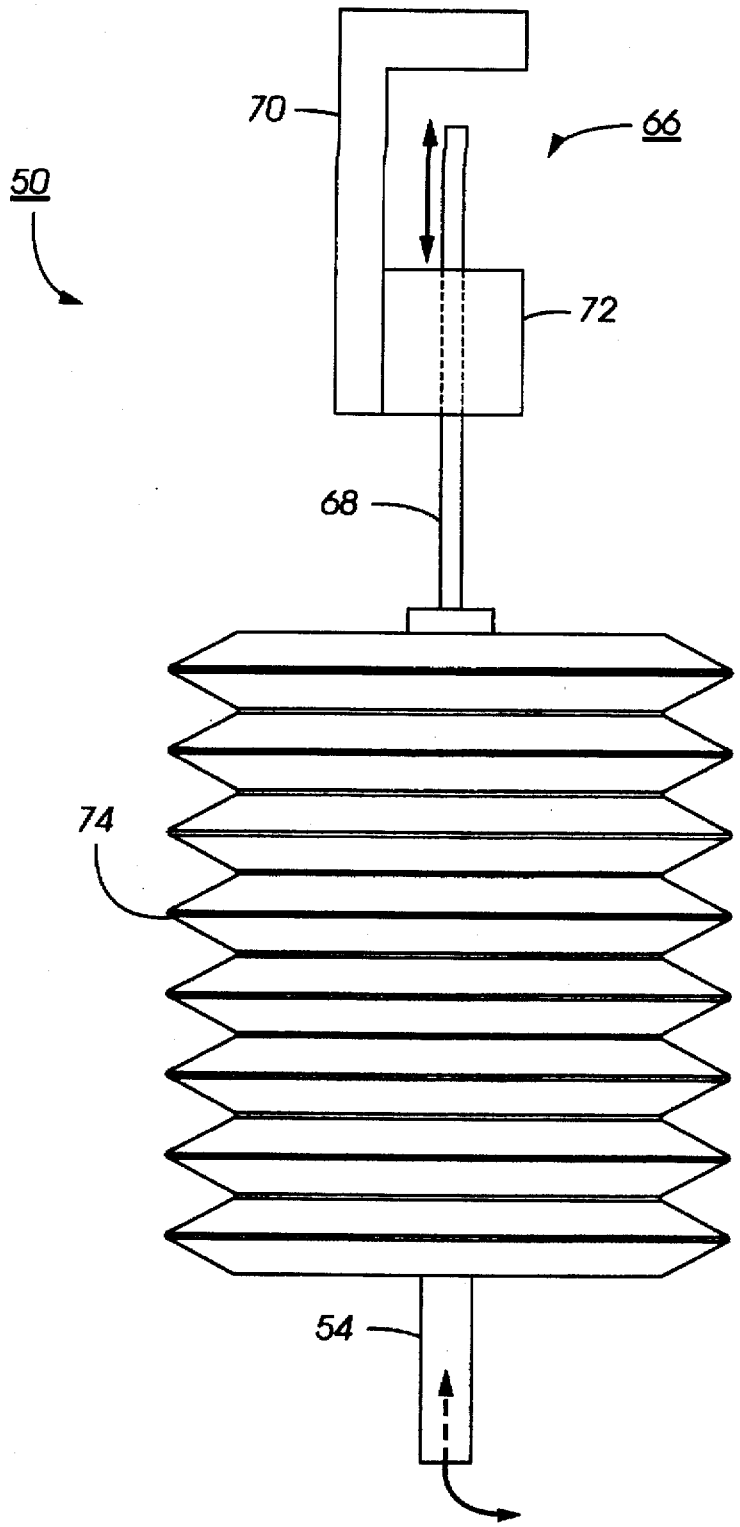
FIG. 5 represents a schematic, side view of an illustrative gas pressure regulating apparatus.

FIG. 5 depicts another embodiment of the gas pressure regulating apparatus 50 wherein conduit 54 is coupled to the hole 52 in the membrane. In this embodiment, the needle valve, the solenoid valve, and the gas injection apparatus are rendered optional. A gas bladder 74 is coupled to the conduit 54. The gas bladder may be in the form of a bellows, preferably fabricated from a plastic or a thin, flexible metal such as aluminum, nickel, or brass, which has a capacity ranging for example from about 0.5 to about 1,000 cc, and preferably from about 1 to about 500 cc depending on the substrate size. The bladder expansion control apparatus 66 comprises a rod 68 coupled to the bladder 74 and an expansion stop 70 operatively coupled to the rod 68. Contact of the end of the rod 68 with the expansion stop 70 limits the expansion of the bladder 74. The expansion of the bladder preferably encompasses slightly more volume than the extra volume created by the evaporation of the solvent to prevent solution burping. A locking device 72 coupled to a pan of the bladder expansion control apparatus such as the rod 68 can be used to lock the bladder in the expanded position while the substrate is submerged in a solution. The locking device 72 may lock one-way such as a ratchet. Alternative embodiments to control the bladder expansion include the following: placing a weight on the bladder; and selecting the bladder material for its expansion properties. Operation of the gas pressure regulating apparatus 50 of FIG. 5 proceeds as follows: the chuck assembly engages an end of the substrate, which is in the form of a tube, and the chuck assembly submerges the substrate into the solution; the gas pressure in the substrate rises and expands the bladder 74 due to the hydrostatic pressure and to solvent evaporation; at this point the bladder expansion is stopped and the locking device 72 locks the bladder in position so that when the substrate is withdrawn and about to break the surface of the solution, the gas volume is maintained by the bladder thereby preventing a burp; when the mated substrate is disengaged from the chuck assembly, the locking device is reset and ready for the next dip coating cycle. The bladder and expansion thereof are sized to accommodate the maximum gas volume due to the hydrostatic pressure and the solvent evaporation. However, for a built-in margin of error to prevent solution burping, the bladder and expansion thereof may be sized to accommodate an additional volume, such as about 10%, beyond the gas volume due to the hydrostatic pressure and the solvent evaporation. The appropriate bladder size and expansion during dip coating may be determined by trial and error.

Other modifications of the present invention may occur to those skilled in the art based upon a reading of the present disclosure and these modifications are intended to be included within the scope of the present invention.

We claim:

1. A chuck assembly for engaging the inner surface of a hollow substrate having a first end engaged to the chuck assembly and an open second end, wherein during lowering of the open second end of the substrate into a liquid there is air present in the interior of the substrate between the chuck assembly and the liquid, the chuck assembly comprising:

(a) a body defining a hole, wherein the body includes a chuck, wherein the hole is positioned to be in communication with the air inside the substrate; and (b) a gas pressure regulating apparatus coupled to the hole defined by the body for regulating the gas pressure inside the substrate by allowing a portion of the air inside the substrate between the chuck assembly and the liquid to flow through the hole into the chuck assembly or by adding gas into the substrate interior through the hole.

2. The chuck assembly of claim 1, wherein the body includes an elastic membrane defining the hole.

3. The chuck assembly of claim 1, wherein the gas pressure regulating apparatus includes a conduit coupled to the hole.

4. The chuck assembly of claim 1, wherein the body includes a plurality of movable members.

5. The chuck assembly of claim 1, wherein the gas pressure regulating apparatus includes a needle valve.

6. The chuck assembly of claim 1, wherein the gas pressure regulating apparatus includes a solenoid valve.

7. The chuck assembly of claim 1, wherein the gas pressure regulating apparatus includes a gas injection apparatus for introducing additional gas into the substrate.

8. The chuck assembly of claim 1, wherein the gas pressure regulating apparatus includes a gas bladder.

9. The chuck assembly of claim 8, wherein the gas bladder is in the form of a bellows.

10. The chuck assembly of claim 8, wherein the gas pressure regulating apparatus includes a bladder expansion control apparatus.

11. The chuck assembly of claim 8, wherein the gas pressure regulating apparatus includes a locking device for locking the gas bladder in an expanded state.

* * * * *